US008154576B2

(12) United States Patent
Sekine

(10) Patent No.: US 8,154,576 B2
(45) Date of Patent: Apr. 10, 2012

(54) IMAGE FORMING APPARATUS, IMAGE FORMING METHOD AND COMPUTER READABLE MEMORY STORING A CONTROL PROGRAM THEREFOR

(75) Inventor: Haruyuki Sekine, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 337 days.

(21) Appl. No.: 12/615,628

(22) Filed: Nov. 10, 2009

(65) Prior Publication Data

US 2010/0124426 A1 May 20, 2010

(30) Foreign Application Priority Data

Nov. 14, 2008 (JP) ..... 2008-292510

(51) Int. Cl.
*B41J 2/447* (2006.01)
*B41J 2/47* (2006.01)

(52) U.S. Cl. ..... 347/233; 347/237

(58) Field of Classification Search ..... 347/129, 347/130, 132, 225, 233, 237, 247
See application file for complete search history.

(56) References Cited

U.S. PATENT DOCUMENTS 5,844,591 A * 12/1998 Takamatsu et al. ..... 347/235
2006/0238848 A1* 10/2006 Sekine ..... 359/204

FOREIGN PATENT DOCUMENTS

| | | | |
|---|---|---|---|
| EP | 2001217 | * | 12/2008 |
| JP | 4-149522 | | 5/1992 |
| JP | 04-149523 | * | 5/1992 |
| JP | 8-76039 | | 3/1996 |
| JP | 2003-182139 | * | 7/2003 |

* cited by examiner

*Primary Examiner* — Huan Tran
(74) *Attorney, Agent, or Firm* — Finnegan, Henderson, Farabow, Garrett & Dunner, L.L.P.

(57) ABSTRACT

An image forming apparatus which performs exposure for "n" lines in one scan by scanning "n" light rays from "n" light sources in a main scanning direction of an image carrier, where "n" is an integer greater than 1, including: a laser driving section; and a control section which, corresponding to density unevenness generated in an adjoining section of a nth exposure in a Nth scan and a first exposure in a N+1th scan, determines a correction value of exposure amount to resolve the density unevenness for the nth exposure amount in the Nth scan and the first exposure amount in the N+1th scan, along with that, determines a correction value of each exposure amount for the "n" lines, based on the correction values of the first and nth exposure amount.

15 Claims, 6 Drawing Sheets

| LD NUMBER | CORRECTION VALUE OF EXPOSURE AMOUNT | TOTAL EXPOSURE AMOUNT OF TWO LINES |
|---|---|---|
| LD #1 | -6 | |
| | | -2 |
| LD #2 | +4 | |
| | | +2 |
| LD #3 | -2 | |
| | | -2 |
| LD #4 | ±0 | |
| | | ±0 |
| LD #5 | ±0 | |
| | | -2 |
| LD #6 | -2 | |
| | | +2 |
| LD #7 | +4 | |
| | | -2 |
| LD #8 | -6 | |

FIG. 8

| LD NUMBER | CORRECTION VALUE OF EXPOSURE AMOUNT | TOTAL EXPOSURE AMOUNT OF TWO LINES |
|---|---|---|
| LD #1 | -6 | |
| | | ±0 |
| LD #2 | +6 | |
| | | ±0 |
| LD #3 | -6 | |
| | | ±0 |
| LD #4 | +6 | |
| | | +12 |
| LD #5 | +6 | |
| | | ±0 |
| LD #6 | -6 | |
| | | ±0 |
| LD #7 | +6 | |
| | | ±0 |
| LD #8 | -6 | |

OPTICAL CHARACTERISTICS :

LD EMITTING POINT INTERVAL : 30μm
COLLIMATOR LENS FOCAL DISTANCE f_col : 30mm
CYLINDRICAL LENS FOCAL DISTANCE f_cy : 112.8mm
SCAN OPTICAL SYSTEM SUB SCANNING RATE m : 1.2

| ARRANGEMENT ANGLE OF LD θ (°) | SUB SCANNING PITCH p (μm) | PITCH ERROR Δp (μm) | |
|---|---|---|---|
| 8.5 | 140.1 | -8.2 | |
| 8.6 | 141.7 | -6.5 | |
| 8.7 | 143.3 | -4.9 | |
| 8.8 | 145.0 | -3.3 | |
| 8.9 | 146.6 | -1.6 | |
| 9.0 | 148.2 | 0.0 | ← REFERENCE |
| 9.1 | 149.9 | 1.6 | |
| 9.2 | 151.5 | 3.3 | |
| 9.3 | 153.1 | 4.9 | |
| 9.4 | 154.8 | 6.5 | |
| 9.5 | 156.4 | 8.2 | |

IMAGE FORMING APPARATUS, IMAGE FORMING METHOD AND COMPUTER READABLE MEMORY STORING A CONTROL PROGRAM THEREFOR

CROSS REFERENCE TO RELATED APPLICATION

The present application is based on Japanese Patent Application No. 2008-292510 filed with Japanese Patent Office on Nov. 14, 2008, and the entire content of which is hereby incorporated by reference.

BACKGROUND OF THE INVENTION

1. Field of Technology

The present invention relates to an image forming apparatus, such as a copying machine and a printer, and a control program therefor, and particularly relates to an multi-beam type image forming apparatus, which has a function of writing an image of a plurality of lines in one scan onto a recording media, such as a photoreceptor, using a laser beam from a plurality of light sources, and a control program therefor.

2. Description of Related Art

An image forming apparatus that performs an image formation of one line in a main scanning direction corresponding to image data and also performs an image formation for one page by repeating the image formation for one line in the main scanning direction in a sub scanning direction is known.

As an example, in an image forming apparatus of an electrophotographic method, a laser beam modulated corresponding to image data is scanned in the main scanning direction of an image carrier, and along with this, an image is formed on the image carrier (photoreceptor drum), which rotates in the sub scanning direction, by using the above mentioned laser beam. In this case, the laser beam is modulated by the image data based on a clock signal (pixel clock) called a dot clock.

In case when the number of rotations of a polygon mirror is increased and a modulation frequency of the laser beam is increased to perform an image formation with high resolution or at high speed, an apparatus becomes large and the cost increases. Consequently, there is known an image forming apparatus, which includes a light source, such as a plurality that is two or not less than three of laser diodes (LD), and which performs an image formation for one page by repeating an image formation for a plurality of lines in the main scanning direction corresponding to the image data in the sub scanning direction using a plurality of laser beams from this plurality of light sources for the image formation at high speed or with high resolution.

Here, FIG. 3 illustrates a concrete example (1) of an image forming apparatus, which executes an image formation for eight lines at a time using eight beams of LD#1-LD#8. In case when an interval of an arrangement of LD#1-LD#8 is set a slightly smaller than a predetermined value, or in case when a distortion of an optical system causes an interval of eight beams of LD#1-LD#8 to be slightly smaller than a predetermined value when irradiated onto an image carrier, the interval of an adjoining section of an eighth exposure in the Nth scan and a first exposure in the N+1th scan ((a) of FIG. 3) becomes wider when compared with the other exposure adjoining section.

In this case, an area of a toner image becomes large, and the density is visually recognized to be high. The section where this density has become high appears at a rate of once in every eight lines. Since a spatial frequency is high, this section is visually hard to be recognized. However, in an image formation using a screen pattern, a moire is generated by an interference with the screen pattern, and there is a problem that the image quality deteriorates.

Next, FIG. 4 illustrates a concrete example (2) of the image forming apparatus, which executes the image formation for eight lines at a time using eight beams of LD#1-LD#8. In case when an interval of an arrangement of LD#1-LD#8 is set a slightly larger than a predetermined value, or in case when a distortion of an optical system causes an interval of eight beams of LD#1-LD#8 to be slightly larger than a predetermined value when irradiated onto an image carrier, the interval of an adjoining section ((b) of FIG. 4) of an eighth exposure in the Nth scan and a first exposure in the N+1th scan becomes narrower when compared with the other exposure adjoining section.

In this case, an area of a toner image becomes smaller, and the density is visually recognized as being low. The section where this density has become low appears at a rate of once in every eight lines. Since a spatial frequency is high, this section is visually hard to be recognized. However, in an image formation using the screen pattern, a moire is generated by an interference with the screen pattern, and there is a problem that the image quality deteriorates.

Further, FIG. 5 illustrates a concrete example (3) of an image forming apparatus, which executes the image formation for eight lines at a time using eight beams of LD#1-LD#8. Here, adjoining exposures (the exposure of the first line and the exposure of a second line, the exposure of the second line and the exposure of a third line, the exposure of the third line and the exposure of a fourth line, the exposure of the fourth line and the exposure of a fifth line, the exposure of the fifth line and the exposure of a sixth line, the exposure of the sixth line and the exposure of a seventh line, and the exposure of the seventh line and the exposure of a eighth line) in Nth scan are executed simultaneously (with no time difference).

On the other hand, in an adjoining section ((c) in FIG. 5) of the exposure of the eighth line in the Nth scan and the exposure of the first line in N+1th scan, the time difference of Nth scan and N+1th scan occurs at an exposure timing.

In this case, even when beam intervals are equal, an existence of the time difference at the time of recording generates reciprocity on the photoreceptor to fail. That is, a reciprocity failure occurs. As a result, even when the beam intervals are equal, the amount of adhesion of the toner differs and the density of an image changes.

In this case, a high illumination reciprocity failure is assumed to have occurred by the exposure of the laser beam. In case when the total exposure amounts are the same for a simultaneous recording of adjoining two lines and a time difference recording of adjoining two, but the exposure times differ, the sensitivity of the photoreceptor decreases as the exposure time becomes shorter. That is, when compared with the eighth line and the first line of the time difference recording ((c) in FIG. 5), the sensitivity decreases in the first line, the second to the seventh lines and the eighth line of the simultaneous recording. Further, the density of the image decreases in the other sections in FIG. 5.

In reality, a density difference in the image occurs in a state where the interval difference of FIG. 3 and FIG. 4 overlaps with the reciprocity failure of FIG. 5. With respect to the density difference generated as mentioned above, in case when the density of the adjoining two lines ((d81) in FIG. 6) of the eighth line and the next first line is high, the exposure amounts of those two lines have to be decreased. On the other hand, in case when the density of the adjoining two lines ((d81) in FIG. 6) of the eighth line and the next first line is low, the exposure amounts of those two lines have to be increased.

However, in case when this technique is used to correct the exposure amounts of the first line and the eighth line, there is a problem that the adjoining two lines of the first line and the second line ((d12) in FIG. 6) and the adjoining two lines of the seventh and the eighth lines ((d78) in FIG. 6), which fundamentally do not need to be corrected, are affected by the correction. That is, in this case, the density of the section "d81" in FIG. 6 becomes proper by the correction. However, the density of "d12" or "d78" is changed to improper by the unnecessary correction.

Consequently, in case when correcting the density of the first and the eight lines to a lower density to resolve the defect in FIG. 6, the correction of the density of the second and the seventh lines to a higher density and the correction of the density of the third and the sixth lines to a lower density are alternately performed to solve the defect of the correction being a problem in FIG. 6. FIG. 7 schematically illustrates a state of this alternating correction.

FIG. 8 illustrates a numerical value of correction of the alternating correction with a concrete example. Here, a case in which the correction for reducing the image density that has increased by performing the correction to the adjoining two lines of LD#1 and LD#8 is illustrated as the concrete example.

In this case, the corrections in the same direction adjoin at the fourth line and the fifth line (FIG. 7 (e45)) arranged in the middle. Thus, the alternating correction fails (refer to FIG. 8). That is, the same density difference that had been generated at the eighth line and the first line before the correction appears at the fourth line and the fifth line. Consequently, the density difference becomes difficult to be resolved.

The later mentioned Unexamined Japanese Patent Application Publication No. H8-76039 discloses a technique of suppressing the image quality deterioration, which is caused by an error of a beam pitch in the sub scanning direction just as described above. In the later mentioned Unexamined Japanese Patent Application Publication No. H8-76039, a countermeasure is taken so that the intervals of the plurality of laser beams are equal. For example, a technique of canceling the density difference just as described above by an adjustment of the exposure amount is disclosed in U.S. Pat. No. 2,685,345 mentioned later.

With respect to the technique of the above mentioned Unexamined Japanese Patent Application Publication No. H8-76039, there is a problem that the mechanical adjustment, such as an adjustment of an optical system, is needed. In this case, an arrangement of mechanical adjustment mechanism creates a new problem of reducing the stability and of generating a distortion.

FIGS. 9*a*, 9*b* and 9*c* illustrate a concrete example of the adjustment of this optical system. Here, a case in which a LD array of eight beams is used as a multi-beam is considered. Here, the exposure of the multi-beam is performed by inclining this 8-beam array by a predetermined angle θ as illustrated in FIG. 9*a* and setting this 8-beam array to a desired pitch p between beams (sub scanning pitch).

Here, an optical characteristic is assumed to be LD emitting point interval: 30 μm, collimator lens focal distance f_col: 30 mm, cylindrical lens focal distance f_cy: 112.8 mm and scan optical system sub scanning rate m: 1.2 times as illustrated in FIG. 9*b*.

A sub scanning pitch p on the photoreceptor drum surface becomes $p=7*d*\sin\theta*f_cy/(f_col*m)$.

In case when the predetermined angle θ is 9.0, an error Δp of a distortion of the angle θ and the sub scanning pitch p becomes as shown in FIG. 9*c*. Here, even when θ shifts from 9.0 degree to only ±0.3 degrees, a pitch error becomes approximately 5 μm (approximately ¼ pixels) that is clearly noticeable. Therefore, with respect to the technique disclosed in Unexamined Japanese Patent Application Publication No. H8-76039, a problem of stability reduction and distortion generation occurs.

In the technique of the above mentioned Japanese Patent No. 2685345, since the light volume is adjusted, a problem of light volume change in the other line as described above occurs. Also there is a problem that a negative effect of the correction cannot be completely solved.

The present invention solves the above mentioned problem. An object of the present invention is to realize an image forming apparatus and a control program therefor that is capable of properly resolving an image density difference generated by a sub scanning direction beam interval difference and a reciprocity failure at the time of an image formation with a simultaneous exposure of a plurality of lines.

SUMMARY OF THE INVENTION

One aspect of the present invention is an image forming apparatus which performs exposure for "n" lines in one scan by scanning "n" light rays from "n" light sources in a main scanning direction of an image carrier and drives the image carrier in a sub scanning direction that is orthogonal to the main scanning direction, where "n" is an integer greater than 1, the image forming apparatus comprising: a laser driving section which performs a light emission drive on the "n" light sources corresponding to image data, respectively; and a control section which, corresponding to density unevenness generated in an adjoining section of a nth exposure in a Nth scan and a first exposure in a N+1th scan, determines a correction value of exposure amount to resolve the density unevenness for the nth exposure amount in the Nth scan and the first exposure amount in the N+1th scan, where the first exposure locates most upstream and the nth exposure locates most downstream in the sub scanning direction in each scan on the image carrier, along with that, determines a correction value of each exposure amount for the "n" lines so that an absolute values of the correction value becomes gradually smaller, while reversing sign, as moving towards a middle of the "n" lines, based on the correction value of the first and nth exposure amounts, for the second to n−1th exposure amounts, and corrects each exposure amount of the "n" light sources from the laser driving section based on each correction value.

Another aspect of the present invention is an image forming control method for an image forming apparatus which performs exposure for "n" lines in one scan by scanning "n" light rays from "n" light sources in a main scanning direction of an image carrier and drives the image carrier in a sub scanning direction that is orthogonal to the main scanning direction, where "n" is an integer greater than 1, the image forming control method comprising: performing a light emission drive on the "n" light sources corresponding to image data, respectively; and determining, corresponding to density unevenness generated in an adjoining section of a nth exposure in a Nth scan and a first exposure in a N+1th scan, a correction value to resolve the density unevenness for the nth exposure amount and the first exposure amount, where the first exposure locates most upstream and the nth exposure locates most downstream in the sub scanning direction in each scan on the image carrier; along with that, determining a correction value of each exposure amount for the "n" lines so that an absolute value of the correction value becomes gradually smaller, while reversing sign, as moving towards a middle of the "n" lines, based on the correction value of the first and nth exposure amounts, for the second to n−1th exposure amounts; and correcting each exposure amount of the "n" light sources from the laser driving section based on each correction value.

Another aspect of the present invention is a computer readable storage medium storing an image forming control program for an image forming apparatus which performs exposure for "n" lines in one scan by scanning "n" light rays from "n" light sources in a main scanning direction of an image carrier and drives the image carrier in a sub scanning direction that is orthogonal to the main scanning direction, where "n" is an integer greater than 1, the control program causing the image forming apparatus to execute an image forming control method comprising: performing a light emission drive on the "n" light sources corresponding to image data, respectively; and determining, corresponding to density unevenness generated in an adjoining section of a nth exposure in a Nth scan and the first exposure in a N+1th scan, a correction value to resolve the density unevenness for the nth exposure amount and the first exposure amount, where the first exposure locates most upstream and the nth exposure locates most downstream in the sub scanning direction in each scan on the image carrier; along with that, determining a correction value of each exposure amount so that an absolute value of the correction value becomes gradually smaller, while reversing sign, as moving towards the middle of the "n" exposure amounts based on the correction value of the above mentioned first and nth exposure amounts for the second to n−1th exposure amounts; and correcting each exposure amount of "n" light sources from the laser driving section based on each correction value.

BRIEF DESCRIPTION OF THE DRAWINGS

FIG. 8 illustrates an explanatory diagram showing a conventional correction numerical value.

DETAILED DESCRIPTION OF THE PREFERRED EMBODIMENTS

Hereafter, preferred embodiments (embodiments) for performing the present invention will be described in detail in reference to drawings.

First Embodiment

An image forming apparatus to which this embodiment of the present invention will be applied is a multi-beam type image forming apparatus that scans "n" number of laser beams from a plurality of light sources in a main scanning direction of an image carrier and collaterally performs an exposure for "n" number of lines.

Hereafter, a configuration of a first embodiment of a multi-beam type image forming apparatus 100 of the present invention will be described in detail based on FIG. 1. This embodiment will be described with attention to a fundamental configuration requirement of an image forming apparatus 100 that uses a plurality of laser beams for the exposure without deteriorating image quality. Therefore, a description of a configuration requirement that is common for the image forming apparatus and is well known will be omitted.

Configuration of the First Embodiment

Figure 1:
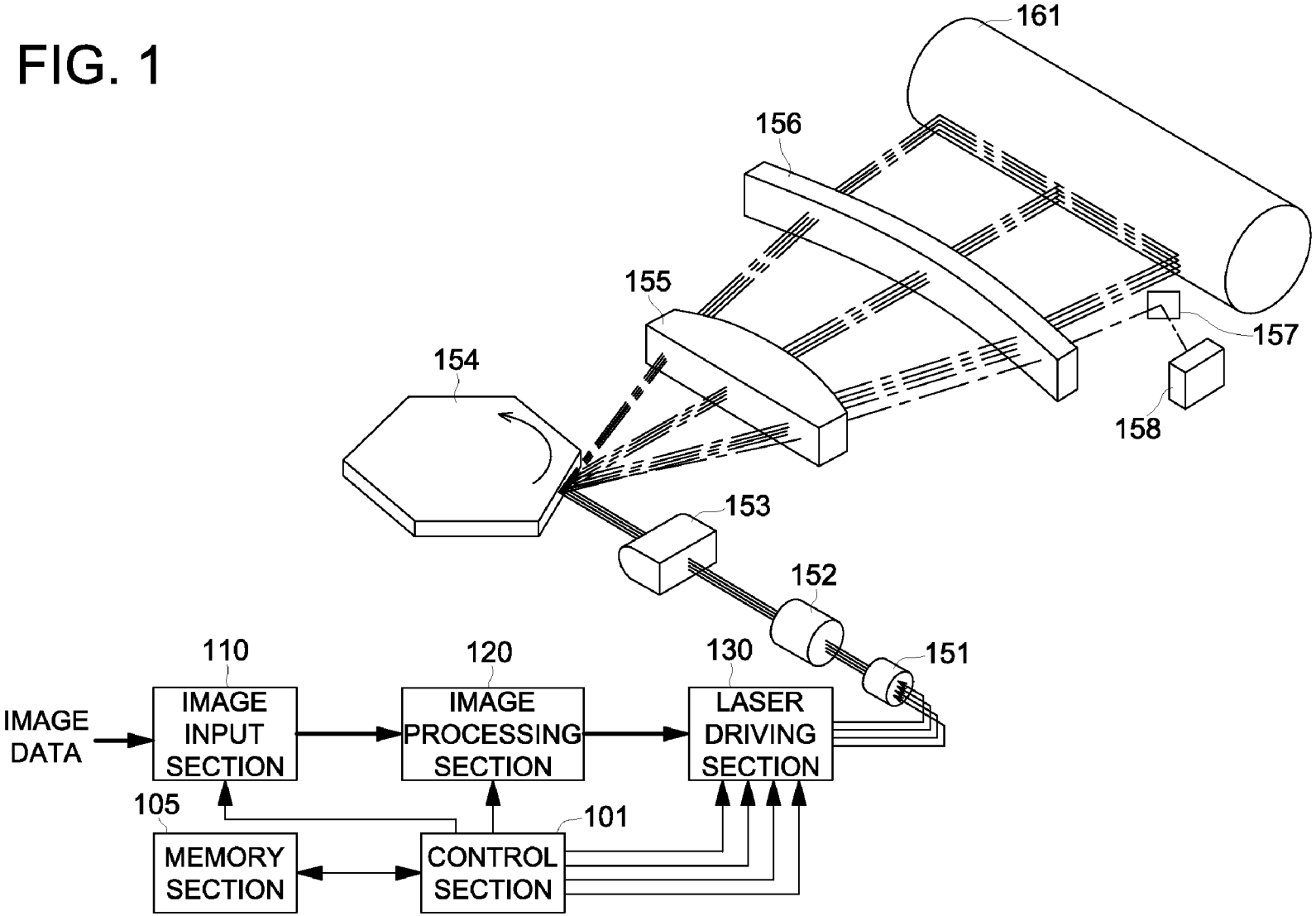
FIG. 1 illustrates a block diagram showing a structure of an image forming apparatus of the present invention.

In FIG. 1, "101" is a control section, which is configured by a CPU for controlling each section of the image forming apparatus 100 and for performing a control of light emission of a laser corresponding to image data and predetermined command data. "105" is a memory section for memorizing data of a density unevenness that is measured in advance and data required for a various correction. "110" is an image input section for receiving the image data from an external apparatus and a scanner, which is not illustrated. "120" is an image processing section for executing a predetermined image processing corresponding to the image data. "130" is a laser driving section for driving the light source based on the control from the control section 101. "150" is an exposure unit for performing a scan with "n" numbers of laser beams. The exposure unit 150 is configured by a various kinds of optical sections described later. "161" is a photoreceptor drum included in a process unit.

The exposure unit 150 in FIG. 1 is configured by a semiconductor laser 151 being a plurality of light sources for generating a plurality of laser beams, a collimator lens 152 and a cylindrical lens 153 for optically performing a various correction onto the laser beam, a polygon mirror 154 for scanning the laser beam in the main scanning direction, an fθ lens 155 for optically performing a correction of a scanning angle, a cylindrical lens 156 for performing an optical correction, a mirror 157 for detecting a horizontal synchronizing signal and a horizontal synchronization sensor 158 for detecting the horizontal synchronizing signal.

In fact, the section illustrated as the semiconductor laser 151 in FIG. 1 may be configured by a plurality of semiconductor lasers and may be configured to include an optical section that synthesizes a plurality of laser beams. The section illustrated as the semiconductor laser 151 may also be a plurality of beam laser arrays formed into one. In FIG. 1, a state in which four lines of laser beams are generated is illustrated under a circumstance of space availability of the paper. However, in a concrete example of a light amount correction described later, eight lines of laser beams are illustrated. "n" number of laser beams is not limited to four or eight.

A plurality of laser beams scanned as mentioned above is scanned onto the photoreceptor drum 161 being the image carrier, and a latent image corresponding to the laser beam is formed on the surface of the photoreceptor drum 161 while considering the rotation of the photoreceptor drum 161 as a scan in the sub scanning direction. In a case of a color image forming apparatus, the exposure unit 150 illustrated here is arranged for a number of colors.

In the above mentioned configuration, the image processing section 120 is an image processing section, which performs a various kinds of image processing required for the image formation. Since the simultaneous exposure is performed with a plurality of light sources in this embodiment, the image processing section 120 has a function for concurrently outputting image data for each line corresponding to a plurality of light sources. Or the image forming apparatus may be arranged so that the image data for one line is outputted from the image processing section 120, then the image data for a plurality of lines is accumulated in the laser driving section 130, and the semiconductor laser 151 is driven for a plurality of lines.

In the above mentioned configuration, with respect to the density unevenness generated in this image forming apparatus, the range of the density unevenness is determined in advance and memorized in the memory section 105. In the above mentioned configuration, the control section 101 defines the correction value of the exposure amount for the laser beam of "n" lines, where "n" is an integer greater than 1. The control section 101 is arranged to correct the exposure value of the light source for "n" lines by the source driving section 130 based on the each correction value.

At the time when the correction value of each laser beam is indicated to the laser driving section 130 from the control section 101, a D-A converter may be arranged between a control output of the control section 101 and a control input of the laser driving section 130 as needed.

That is, in this embodiment, the image forming apparatus performs the exposure for "n" lines in one scan by scanning "n" light rays from "n" light sources in the main scanning direction of the image carrier and drives the image carrier in the sub scanning direction that is orthogonal to the above mentioned main scanning direction, where "n" is an integer greater than 1. The image forming apparatus includes the laser driving section 130 and the control section 101. The laser driving section 130 performs a light emission drive on the above mentioned "n" light sources corresponding to the image data, respectively. The control section 101 determines the correction value to resolve the above mentioned density unevenness for the first exposure amount and the nth exposure amount corresponding to the density unevenness generated in the adjoining section of the nth exposure in the Nth scan and the first exposure in the N+1th scan. Along with that, the control section 101 also determines the correction value of each exposure amount while reversing the sign so that an absolute value of the correction value becomes gradually smaller as moving towards the middle of the "n" exposure amounts based on the correction value of the above mentioned first and nth exposure amounts for the second to n−1th exposure amounts. The control section 101 also corrects the exposure amount of "n" light sources 151 from the laser driving section 130 based on each correction value.

Here, the interval of the "n" light rays in the sub scanning direction results in the density unevenness generated in the adjoining section of the nth exposure in the Nth scan and the first exposure in the N+1th scan.

Here, the reciprocity failure caused by an exposure time difference of an exposure timing in Nth scan and an exposure timing in N+1th scan results in the density unevenness generated in the adjoining section of the nth exposure in the Nth scan and the first exposure in the N+1th scan.

Or the combination of the interval of the "n" light rays in the sub scanning direction and of the reciprocity failure caused by an exposure time difference of an exposure timing in Nth scan and an exposure timing in N+1th scan results in the density unevenness generated in the adjoining section of the nth exposure in the Nth scan and the first exposure in the N+1th scan.

The correction value is determined to include "0" as the correction value for the exposure amount in the vicinity of middle of "n" in the correction of the exposure amount. Further, the correction of the exposure amount is performed in the direction in which the positive and negative signs of a light volume change $\alpha$, which is the total amount of adjoining two lines of "a" line and "b" line, and of a light volume change $\beta$, which is the total exposure amount of adjoining two lines of "b" line and "c" line, become opposite of each other.

Figures 2, 3:
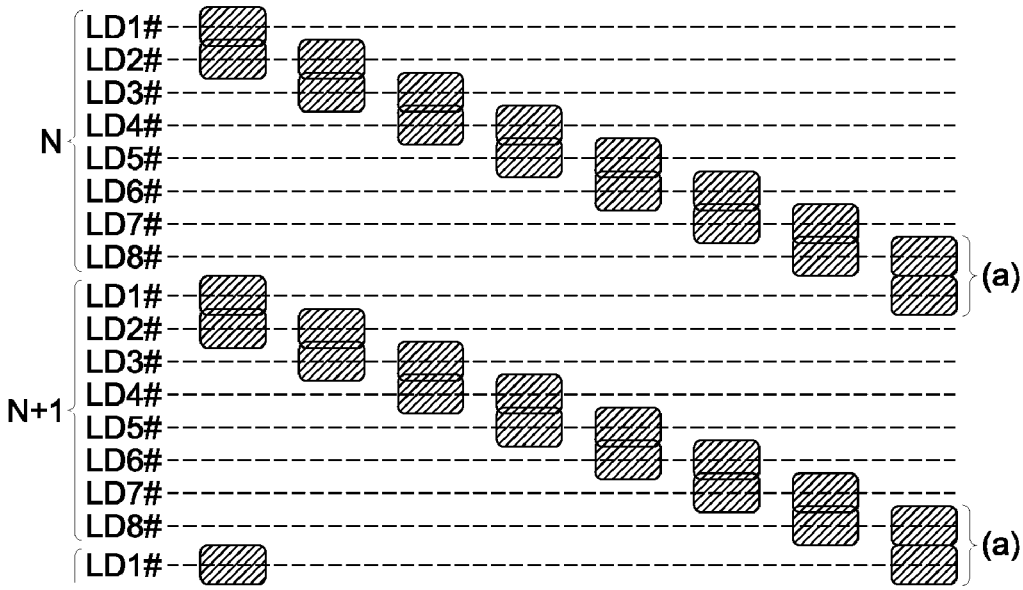
FIG. 2 illustrates an explanatory diagram showing a configuration of an image forming apparatus of a first embodiment of the present invention.
FIG. 3 illustrates an explanatory diagram showing a conventional condition.
Figure 4:
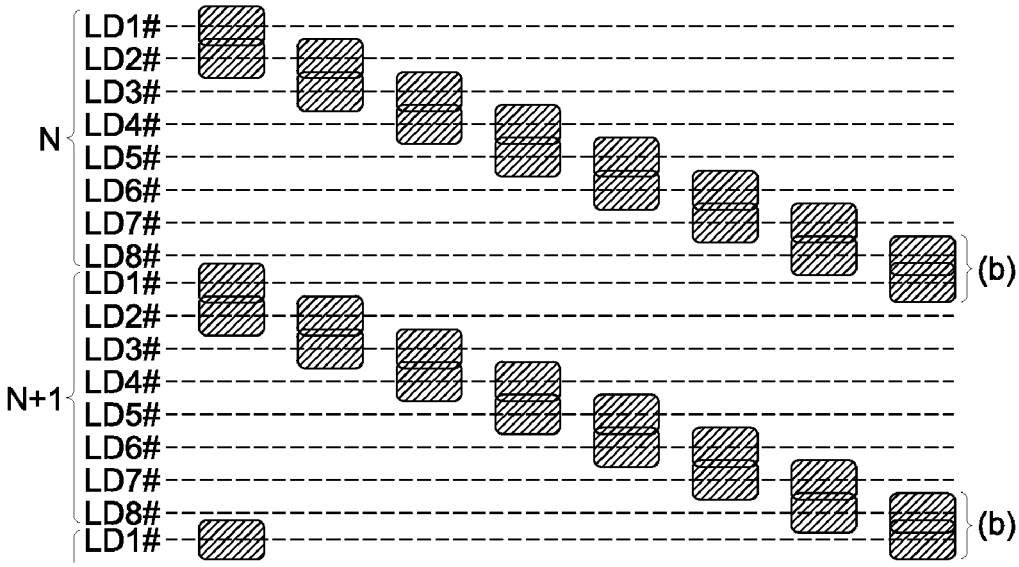
FIG. 4 illustrates an explanatory diagram showing a conventional condition.
Figure 5:
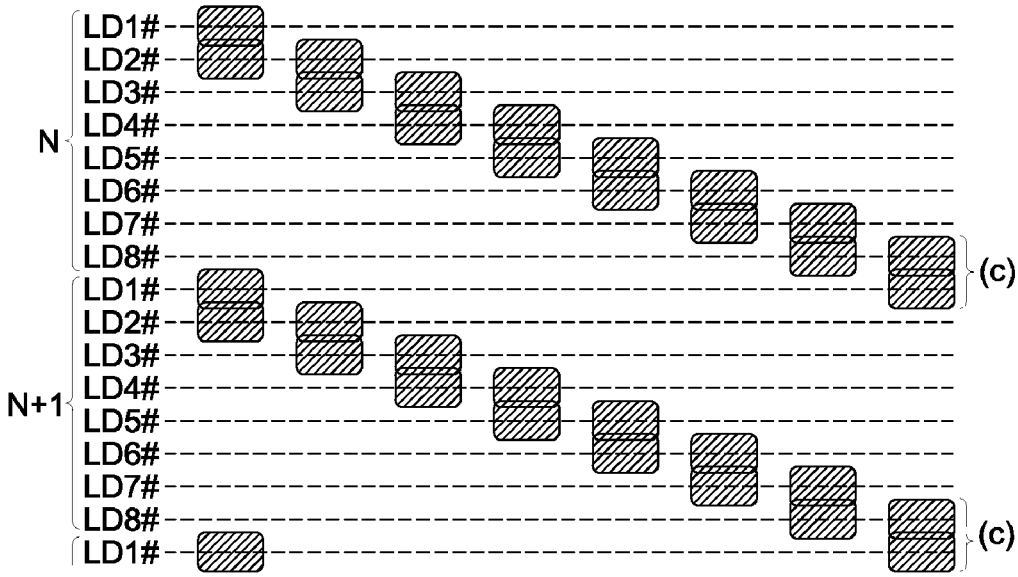
FIG. 5 illustrates an explanatory diagram showing a conventional condition.
Figure 6:
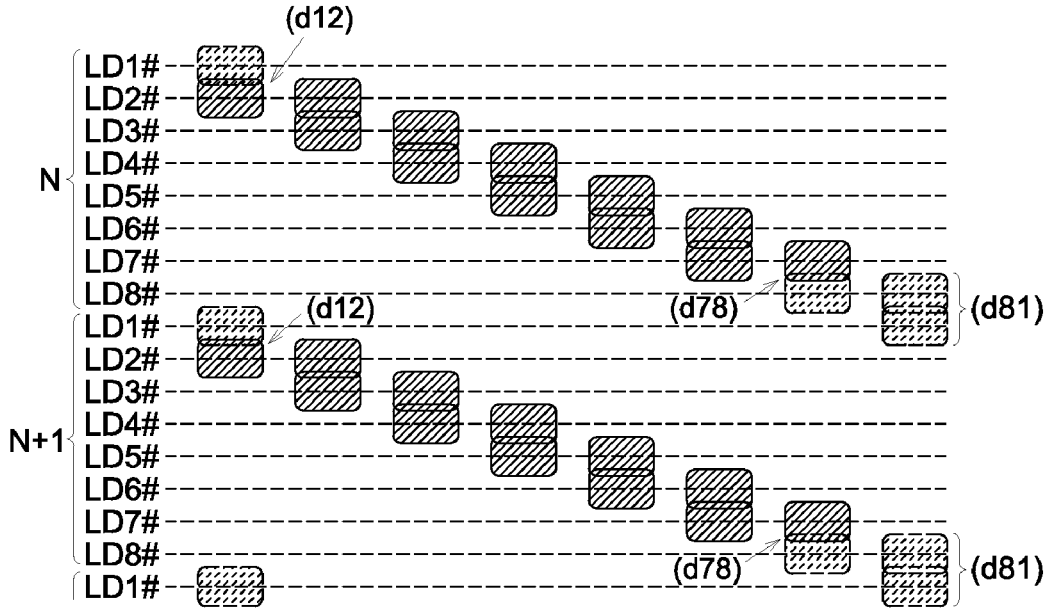
FIG. 6 illustrates an explanatory diagram showing a conventional condition.
Figure 7:
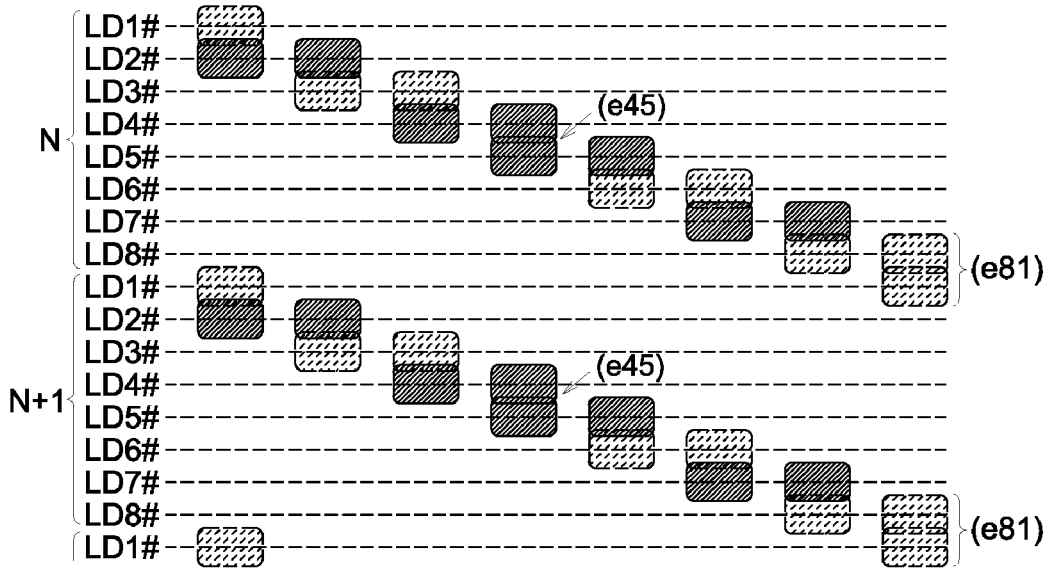
FIG. 7 illustrates an explanatory diagram showing a conventional condition.
Figures 9A, 9B, 9C:
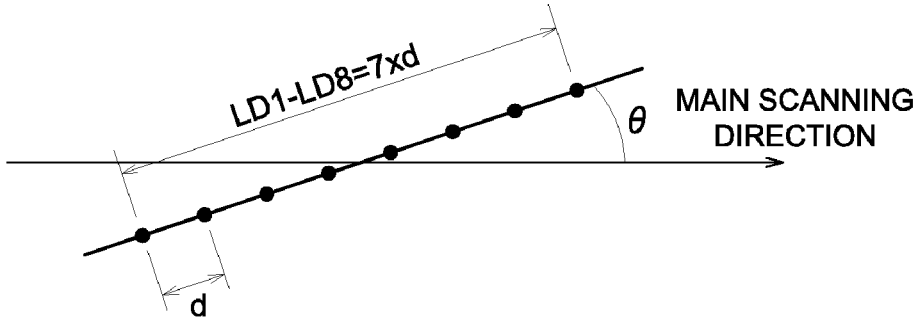
FIGS. 9*a*, 9*b* and 9*c* illustrate an explanatory diagram showing a conventional condition.

Herewith, at the time of image formation performed with the simultaneous exposure of "n" lines, it becomes possible to properly resolve the image density difference generated by the sub scanning direction beam interval difference and the reciprocity failure. FIG. 2 illustrates an example of a concrete example of the correction value just as mentioned above.

Here, first, the correction values of the first exposure amount and the nth exposure amount are determined to resolve the above mentioned density unevenness corresponding to the density unevenness generated in the adjoining section of the nth exposure in the Nth scan and of the first exposure in the N+1th scan.

For example, with respect to LD#1 and LD#8, the correction value is determined to be "−6". This correction value is the same as the value illustrated in FIG. 8. That is, in case when the image density increases with the adjoining two lines of LD#1 and LD#8, a case in which the correction to reduce the increase of the density is performed is illustrated as the concrete example.

The correction value of each exposure amount is determined while the sign is reversed so that an absolute value of the correction value becomes gradually smaller as moving towards the middle of the "n" exposure amounts based on the correction value of the above mentioned first and nth exposure amounts for the second to n−1th exposure amounts.

For example, with respect to LD#2 and LD#7, the correction value is determined to be "+4" so that the absolute value of the correction value becomes smaller and the sign reverses. With respect to this correction value, although it is slight, the absolute value is smaller than "+6" in FIG. 8.

In case when moving further towards the middle, with respect to LD#3 and LD#6, the correction value is determined to be "−2" so that the absolute value of the correction value becomes smaller and the sign reverses. With respect to this correction value, the absolute value is further smaller than "−6" in FIG. 8.

In case when moving further towards the middle, with respect to LD#4 and LD#5, the correction value is determined to be "0" so that the absolute value of the correction value becomes smaller. With respect to this correction value, the absolute value is further smaller than "+6" in FIG. 8.

By performing the correction as mentioned above, the correction of the exposure amount is performed in the direction in which the positive and negative signs of the light volume change $\alpha$, which is the total amount of adjoining two lines of "a" line and "b" line, and of the light volume change $\beta$, which is the total amount of adjoining two lines of "b" line and "c" line, become opposite of each other. That is, in this concrete example of FIG. 2, "−2" and "+2" appear alternately for the total amount of the light volume change of two lines. These values change very frequently. In case when these values are averaged, the averaged value becomes 0. Thereby, the density unevenness becomes visually hard to be seen.

On the other hand, in the conventional FIG. 8, most of the total amount of the light volume change of two lines is "0". However, there is one section in which a large density unevenness of "+12" has newly occurred and the density unevenness is clearly visible. As mentioned above, according to the embodiment of the present invention, at the time of the image formation with the simultaneous exposure of "n" lines, it becomes possible to properly resolve the image density difference generated from the sub scanning direction beam interval difference and the reciprocity failure.

The concrete numerical values of FIG. 2 are an example, and are not limited to this. Further, LD#1 and LD#8, LD#2 and LD#7, LD#3 and LD#6, and LD#4 and LD#5 have the same numerical values. However, the numerical values are not limited to these. There is not a problem even when the values are asymmetry, that is, different values. The correction value has been illustrated integrally here. However, a numerical value in a detailed number of a real number may be used.

Other Embodiments

With respect to the above mentioned embodiment, an image forming apparatus of an electrophotographic method using the laser beam has been described. However, the present invention is not limited to this. For example, each embodiment of the present invention can be applied to a various image forming apparatuses, such as a laser imager that performs an exposure to a photographic paper using the laser beam. Thus, a satisfactory result can be obtained.

Each embodiment of the present invention is capable of being applied to a case in which a light source other than a semiconductor laser (LD) is used as the light source.

What is claimed is:

1. An image forming apparatus which performs exposure for "n" lines in one scan by scanning of "n" light rays from "n" light sources in a main scanning direction of an image carrier and drives the image carrier in a sub scanning direction that is orthogonal to the main scanning direction, where "n" is an integer greater than 1, the image forming apparatus comprising:

a laser driving section which performs a light emission drive on the "n" light sources corresponding to image data, respectively; and a control section which, corresponding to density unevenness generated in an adjoining section of a nth exposure in a Nth scan and a first exposure in a N+1th scan, determines a correction value of exposure amount to resolve the density unevenness for the nth exposure amount in the Nth scan and the first exposure amount in the N+1th scan, where the first exposure locates most upstream and the nth exposure locates most downstream in the sub scanning direction in each scan on the image carrier, along with that, determines a correction value of each exposure amount for the "n" lines so that an absolute values of the correction value becomes gradually smaller, while reversing sign, as moving towards a middle of the "n" lines, based on the correction value of the first and nth exposure amounts, for the second to n−1th exposure amounts, and corrects each exposure amount of the "n" light sources from the laser driving section based on each correction value.

2. The image forming apparatus of claim 1, wherein an interval of the "n" light rays in the sub scanning direction results in the density unevenness generated in the adjoining section of the nth exposure in the Nth scan and the first exposure in the N+1th scan.

3. The image forming apparatus of claim 1, wherein a reciprocity failure caused by an exposure time difference of an exposure timing in Nth scan and an exposure timing in N+1th scan results in the density unevenness generated in the adjoining section of the nth exposure in the Nth scan and the first exposure in the N+1th scan.

4. The image forming apparatus of claim 1, wherein the correction value is determined to include "0" as the correction value for the exposure amount at a line near a middle of the "n" lines in the correction of the exposure amount.

5. The image forming apparatus of claim 1, wherein the correction of the exposure amount is performed so that a direction in which a positive and negative sign of a total light change $\alpha$ of adjoining two lines of "a" line and "b" line and a direction in which a positive and negative sign of a total light amount change $\beta$ of adjoining two lines of "b" line and "c" line are opposite from each other.

6. An image forming control method for an image forming apparatus which performs exposure for "n" lines in one scan by scanning "n" light rays from "n" light sources in a main scanning direction of an image carrier and drives the image carrier in a sub scanning direction that is orthogonal to the main scanning direction, the image forming control method comprising:

performing a light emission drive on the "n" light sources corresponding to image data, respectively; and determining, corresponding to density unevenness generated in an adjoining section of a nth exposure in a Nth scan and a first exposure in a N+1th scan, a correction value to resolve the density unevenness for the nth exposure amount and the first exposure amount, where the first exposure locates most upstream and the nth exposure locates most downstream in the sub scanning direction in each scan on the image carrier;

along with that, determining a correction value of each exposure amount for the "n" lines so that an absolute value of the correction value becomes gradually smaller, while reversing sign, as moving towards a middle of the "n" lines, based on the correction value of the first and nth exposure amounts, for the second to n−1th exposure amounts; and correcting each exposure amount of the "n" light sources from the laser driving section based on each correction value.

7. The image forming control method of claim 6, wherein an interval of the "n" light rays in the sub scanning direction results in the density unevenness generated in the adjoining section of the nth exposure in the Nth scan and the first exposure in the N+1th scan.

8. The image forming control method of claim 6, wherein a reciprocity failure caused by an exposure time difference of an exposure timing in Nth scan and an exposure timing in N+1th scan results in the density unevenness generated in the adjoining section of the nth exposure in the Nth scan and the first exposure in the N+1th scan.

9. The image forming control method of claim 6, wherein the correction value is determined to include "0" as the correction value for the exposure amount at a line near a middle of the "n" lines in the correction of the exposure amount.

10. The image forming control method of claim 6, wherein the correction of the exposure amount is performed so that a direction in which a positive and negative sign of a total light change $\alpha$ of adjoining two lines of "a" line and "b" line and a direction in which a positive and negative sign of a total light amount change $\beta$ of adjoining two lines of "b" line and "c" line are opposite from each other.

11. A computer readable storage medium storing an image forming control program for an image forming apparatus which performs exposure for "n" lines in one scan by scanning a "n" light rays from "n" light sources in a main scanning direction of an image carrier and drives the image carrier in a sub scanning direction that is orthogonal to the main scanning direction, the control program causing the image forming apparatus to execute an image forming control method comprising:

performing a light emission drive on the "n" light sources corresponding to image data, respectively; and determining, corresponding to density unevenness generated in an adjoining section of a nth exposure in a Nth scan and the first exposure in a N+1th scan, a correction value to resolve the density unevenness for the nth exposure amount and the first exposure amount, where the first exposure locates most upstream and the nth exposure locates most downstream in the sub scanning direction in each scan on the image carrier;

along with that, determining a correction value of each exposure amount so that an absolute value of the correction value becomes gradually smaller, while reversing sign, as moving towards the middle of the "n" exposure amounts based on the correction value of the above mentioned first and nth exposure amounts for the second to n−1th exposure amounts; and correcting each exposure amount of "n" light sources from the laser driving section based on each correction value.

12. The computer readable storage medium of claim 11, wherein an interval of the "n" light rays in the sub scanning direction results in the density unevenness generated in the adjoining section of the nth exposure in the Nth scan and the first exposure in the N+1th scan.

13. The computer readable storage medium of claim 11, wherein a reciprocity failure caused by an exposure time difference of an exposure timing in Nth scan and an exposure timing in N+1th scan results in the density unevenness generated in the adjoining section of the nth exposure in the Nth scan and the first exposure in the N+1th scan.

14. The computer readable storage medium of claim 11, wherein the correction value is determined to include "0" as the correction value for the exposure amount at a line near a middle of the "n" lines in the correction of the exposure amount.

15. The computer readable storage medium of claim 11, wherein the correction of the exposure amount is performed so that a direction in which a positive and negative sign of a total light change $\alpha$ of adjoining two lines of "a" line and "b" line and a direction in which a positive and negative sign of a total light amount change $\beta$ of adjoining two lines of "b" line and "c" line are opposite from each other.

* * * * *